United States Patent [19]

Frommann et al.

[11] Patent Number: 4,698,897

[45] Date of Patent: Oct. 13, 1987

[54] MAKING HOT ROLLER STEEL STRIP FROM CONTINUOUSLY CAST INGOTS

[75] Inventors: Klaus Frommann, Meerbusch; Ulrich Skoda, Duisburg Marxloh; Peter Meyer, Duisburg Baerl, all of Fed. Rep. of Germany

[73] Assignee: Mannesmann AG, Duesseldorf, Fed. Rep. of Germany

[21] Appl. No.: 550,536

[22] Filed: Nov. 10, 1983

[30] Foreign Application Priority Data

Nov. 11, 1982 [DE] Fed. Rep. of Germany ..... 3241745

[51] Int. Cl.[4] ..... B21B 1/00; B21B 13/22; B22D 11/126

[52] U.S. Cl. ..... 29/527.7; 29/100; 164/476

[58] Field of Search ..... 29/527.7, 527.6, 527.5, 29/33 Q, 33 S, 700, 849; 164/476

[56] References Cited

U.S. PATENT DOCUMENTS

| | | | |
|---|---|---|---|
| 3,648,359 | 3/1972 | Dennis | 29/527.7 |
| 4,170,815 | 10/1979 | Tokitsu | 29/527.7 |
| 4,217,095 | 8/1980 | Tokitsu | 29/527.7 |
| 4,229,878 | 10/1980 | Ushijima | 29/527.7 |
| 4,235,646 | 11/1980 | Neufeld | 29/527.7 |
| 4,513,490 | 4/1985 | Sendgimir | 29/527.7 |

FOREIGN PATENT DOCUMENTS

| | | | |
|---|---|---|---|
| 153750 | 12/1979 | Japan | 29/527.7 |
| 2129723A | 5/1984 | United Kingdom | 29/527.7 |

*Primary Examiner*—Mark Rosenbaum
*Assistant Examiner*—Irene Graves Golabi
*Attorney, Agent, or Firm*—Ralf H. Siegemund

[57] ABSTRACT

Continuously cast thin slab ingots are coiled, cut, uncoiled and rolled down to thin strip material. For a single casting line a single back and forth rolling stand is used; multiple continuous casting lines can service a single unidirectional rolling mill. The rolling temperature is attained by heat retention in the coils.

14 Claims, 4 Drawing Figures

MAKING HOT ROLLER STEEL STRIP FROM CONTINUOUSLY CAST INGOTS

BACKGROUND OF THE INVENTION

The present invention relates to the manufacture of hot rolled steel strip or skelp under utilization of a continuously cast billet or ingot whereby the steel or strip making is to follow immediately the continuous casting operation.

The conventional method for making hot rolled steel strip or skelp uses a continuously cast slab ingot which is made available in some fashion and after heating to rolling temperature the ingot is rolled in several passes under utilization of several rolling stands. Typically, rolling is carried out in two stages which could be termed prerolling stage and finishing rolling stage, respectively. Therefore, this known method and procedure is not tied in with the continuous casting in a continuous or quasi-continuous operation.

The known method as described for making hot steel strip or skelp requires a considerable amount of capital expenditure. Determining factors here are the continuous casting machine and particularly the size thereof and further determining factors are the rolling stands as such. Here it has to be considered that the rolls needed for rolling down the rather thick, continuously cast ingot require strong initial stages and stands with correspondingly high consumption of energy. Also, the hall in which the equipment is placed is correspondingly quite large. casting thick ingots is indeed large and expensive, it is apparent that such a machine as an input stage for subsequent rolling is useful only if the overall throughput is indeed very large.

Recently, the demand for hot strip rolling plants has increased whereby particularly relatively small production quantities may have to be accommodated so that it is desirable to provide for an economic way of manufacturing such strip.

DESCRIPTION OF THE INVENTION

It is an object of the present invention to provide a new and improved method and equipment for the manufacture of hot rolled steel strip or skelp under utilization of continuous casting which is to precede immediately the rolling operation whereby the capital expenditure as well as the consumption of energy is reduced as compared with prior art equipment.

In accordance with the preferred embodiment of the present invention, it is suggested to provide the steel strip in the following manner. First, one or more steel strips being relatively thick are produced by means of continuous casting; each of the strips so made is coiled after complete solidification; coiling requires occasionally transverse cutting of the cast ingot or ingots whenever a coil has been completed, for example, under consideration of the attained weight; each of the coiled strips is subsequently uncoiled but preferably heating is provided to prevent at least further outflow of heat from the solidified cast ingots particularly during the transfer of the coil from coiling to uncoiling. Some additional heating may be required to raise the temperature to hot rolling levels. The uncoiled strip is subsequently rolled down to a flatter hot rolled strip or skelp.

The invention is based on the principle that a quasi-continuous manufacture of hot rolled strip under utilization of continuously cast ingot material offers the premise of saving energy. Particularly, it is avoided that the ingot material to be rolled has to be reheated nor is it necessary that extensive facilities are prepared for intermediate off-line storage. Moreover, the invention is based on the proposition that one should begin with a strip-like ingot that is being cast by way of continuous casting so that, contrary to past procedure involving regular slab ingots, the amount of cross-sectional reduction with a commensurate high degree of deformation and a commensurately high expenditure in deformation energy can be avoided. This features is already instrumental for avoiding extensive capital expenditure for prerolling and high energy consuming drives. The machine to be used for continuous casting can be lighter and does not have to be as high and as bulky as is conventionally practiced. Therefore, the continuous casting per se is already more economical.

It has been attempted in the past to provide for a continuous rolling of material as it emerges from a machine for continuous casting. This, however, has always led to problems because the maximum casting speed by means of which the ingot emerges from the casting mold is considerably lower than the lowest possible rolling speed in a conventional rolling mill. Certain specialized construction for rolling stands have been proposed wherein very high degrees of reduction was deemed possible at very low rolling speeds. However, attempts along this line have not been satisfactory as far as results are concerned.

The present invention provides for a compensation of the different operational speeds as far as casting on one hand and rolling the cast ingots on the other hand is concerned. Instrumental here is the coiling of the already strip-like casting ingots to be separated from the endless string of casting, and uncoiling prior to insertion into the rolling mill. This way one establishes a buffer zone between casting and rolling to thereby render casting speed and rolling speed independent from each other. Herein, the separation of a coil from the following casting string should be carried out such that the transfer of the coil towards the uncoiling structure does not impede the continuation of casting. Moreover, the buffer zone between coiling and uncoiling should be utilized for preservation of the thermal content of the casting by providing heating at least sufficient that furthere outflux of heat from the casting is prevented; the coil's temperature should be raised to or maintained for hot rolling levels. The coil configuration itself is already instrumental in reducing further outflux of heat simply because the surface from which heat can emanate is reduced. The furnace should be of the rotary variety.

Equipment for carrying out the inventive concept should cast a strip-like ingot having a thickness between 20 to 65 mm at a width between 500 and 1500 mm. Therefore the thickness to width ratio in the cross-sectional dimension of this casting is already quite low. Such a machine requires a relatively low capital expenditure. The coiling downstream from the casting is preferably carried out without mandrel; such coiling and reeling structures are available. Likewise known are uncoiling devices for purposes of feeding, for example, such a coiled strip into structure which requires a flat configuration. For example, by means of rolls such an uncoiled flattened strip can now be fed to a rolling mill. The separation of the casting from a coil is preferably carried out by means of a transverse cutter disposed at such a distance from the coiling structure so that after cutting the end of this coil from the newly produced front end of the casting can rapidly be increased through increasing the coiling speed to thereby gain time during which the coil can be removed from the coiling device so that the latter is ready for a new coiling step when the newly produced front end of the casting arrives.

The rolling operation can be carried out in a bi-directional rolling mill with backing rolls wherein the uncoiled strip is moved back and forth under utilization of coiling and reeling furnaces which coil the strip as it is passed through the mill and uncoiled again for the next rolling step in the opposite direction. Therefore, the conventional procedure for providing space for a flat strip is not needed which likewise reduces capital expenditure for the inventive equipment. It should be pointed out here that the on-line back and forth movement of the strip as it is being rolled within the rolling stand makes use of the fact that the rolling is carried out at a much faster speed and higher rate as compared with the continuous casting operation.

Alternatively, rolling can be carried out in a multistand rolling mill through which the strip passes in a continuous operation. In this case, the single rolling line can be serviced by multiple continuous casting machines cooperating commensurately with multiple cutters and multiple coilers but a common furnace for temporary storage of the coils and a common feeder to a single uncoiling device.

In cases, it may be advisable to provide a first reduction step right after continuous casting while the ingot is still quite soft, just ahead of cutting in order to make sure that the cut ingots can indeed be coiled. Also, there may be a hot inspection provided just prior to coiling.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawing, FIGS. 1 and 2 illustrate a machine for continuous casting including a tundish or ladle and mold for continuous casting from which a casting string emerges and is veered into the horizontal. Upon reaching horizontal orientation and after complete solidification, the casting is subjected to cutting by means of a cutting device 2 whenever such cutting is desired. Downstream from the cutter there is provided a coiling device 3 which winds the casting string to assume a coiled configuration. This coil is placed, for example, into a rotary furnace 4 which constitutes a buffer for one or more coiled casting.

Whenever the coiled casting is needed it is uncoiled in a station 5 and passed into and through a four-high reversing rolling mill with backing rolls. There being reeling furnaces 6 and 8 provided upstream and downstream respectively from the rolling stand 7 wherein the rolled strip after each pass through the stand 7 is alternatingly coiled and uncoiled. The strip or skelp rolling of which has been completed, is finally coiled in a reeling stand 9 disposed below the normal operating plane or floor.

Figure 1:
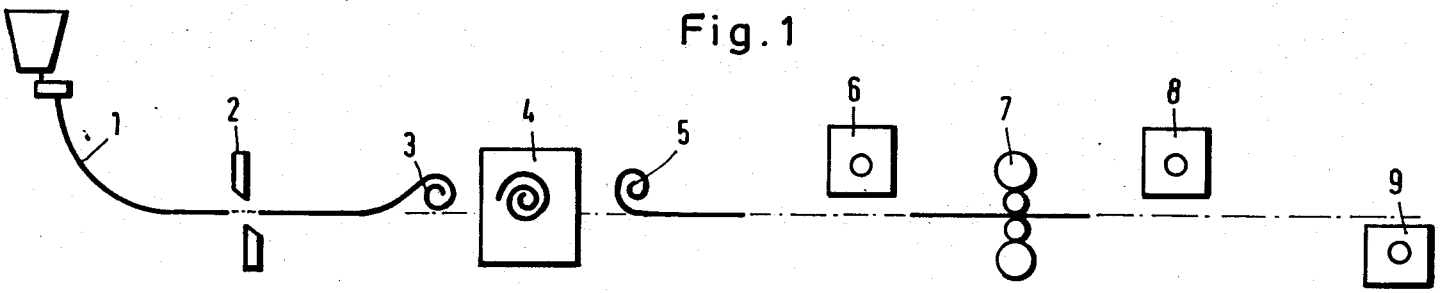
FIG. 1 is a schematic diagram of a system for practicing the method in accordance with the preferred embodiment of the invention under best mode principles of operation.
Figure 2:
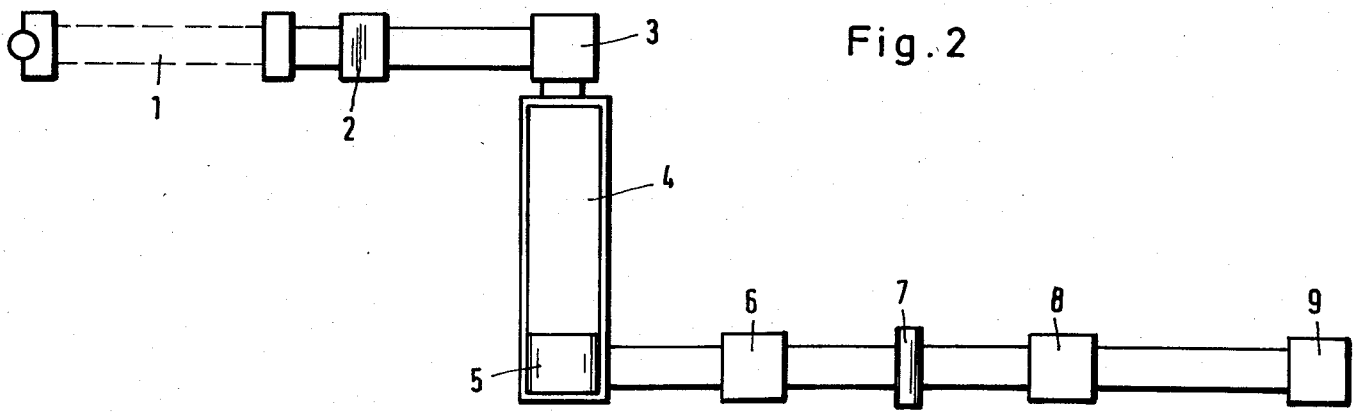
FIG. 2 is a top view of the system shown in FIG. 1.

FIG. 2 illustrates in particular that various components, shown in side elevation in FIG. 1, are in fact laterally offset wherein the lateral displacement is inherent in the transverse arrangement of the storage and buffer furnace 4. The furnace must, of course, include a correspondingly transversely operating transport structure for the coiled castings. In particular, the furnace provides for transport movement of such a coil from the coiling structures 3 to the uncoiling structure 5, both being in line with the furnace.

Figure 3:
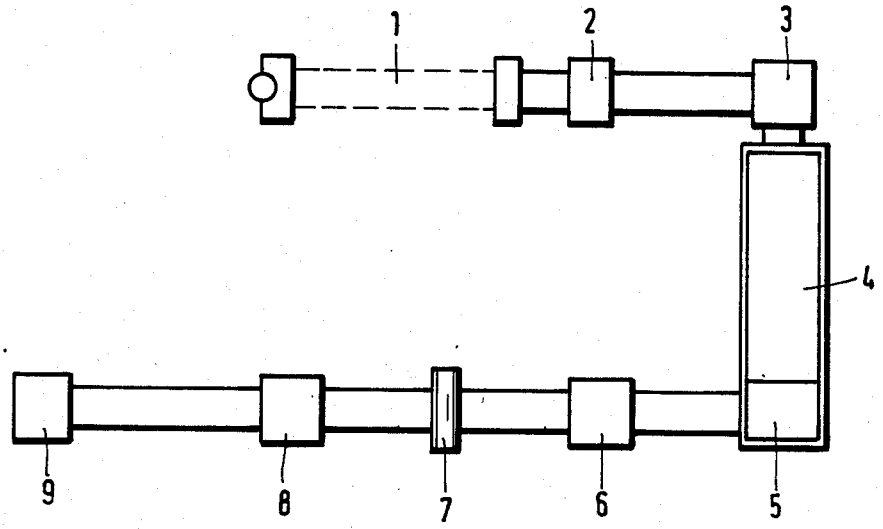
FIG. 3 is a modified arrangement of said equipment also being shown in top view.

The arrangement shown in FIG. 3 is essentially the same as the arrangement shown in FIGS. 1 and 2 and particularly the same or the same type of equipment are used. However, it can be seen that the rolling and reeling furnaces are arranged more or less alongside the continuous casting portion of the arrangement so that the coil, after having been moved through the furnace 4, now reverses direction as far as further processing is concerned. It can readily be seen that the arrangement of FIG. 3 does not require a relatively long manufacturing hall as is necessary if the components are arranged as shown in FIGS. 1 and 2.

Turning now to the equipment shown in FIG. 4, numeral 1 refers again generally to the immediate facility and machine for continuous casting and 2 is again the cutting facility in which the basically endless castings are cut into suitable length for coiling. However, it may be adviseable to interpose a reducing stand 12 between the continuous casting machine and the cutter 2 in order to reduce the thickness of the ingot and make it more suitable for coiling. A hot inspection station 10 is disposed downstream from the cutter. Moreover, this particular example illustrates that the coiling device 3 as well as the uncoiling structure and equipment 5 are all disposed inside the furnace 4.

Figure 4:
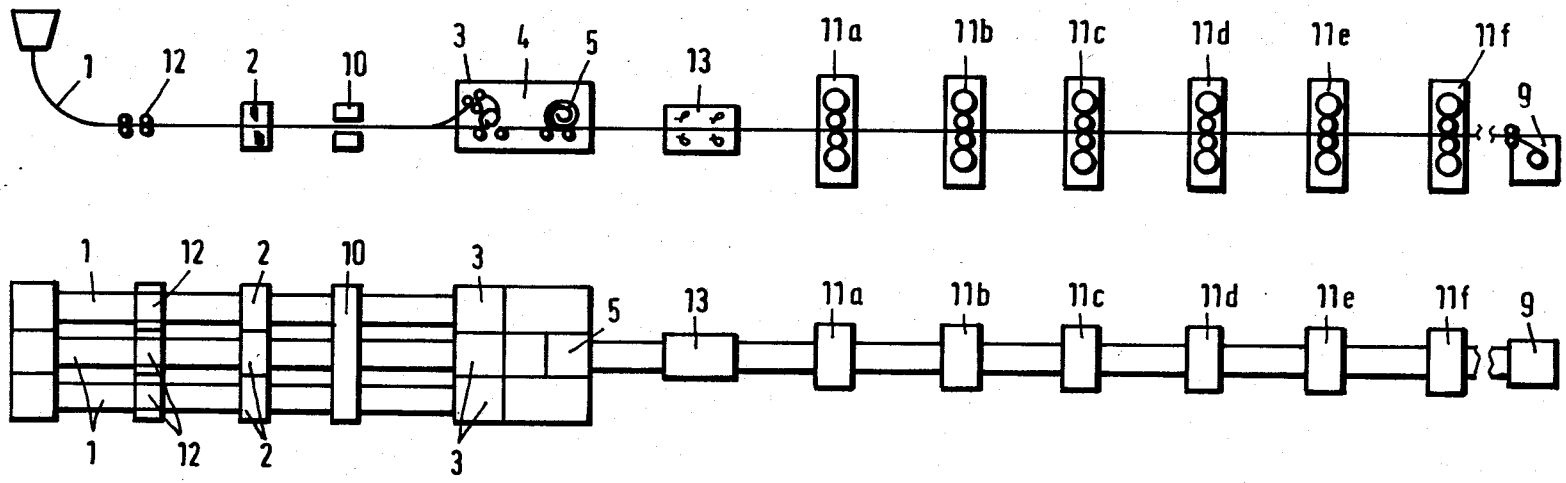
FIG. 4 is a side and top elevation also shown somewhat schematically and showing a six stand rolling operation directly following multiple continuous casting still in accordance with the present invention.

As can be seen particularly from the bottom part of FIG. 4, the casting machine here includes in fact three casting lines 1*a*, 1*b* and 1*c*. Also, the reducing stage 12 is provided in triplicate; so are the cutters, there being cutter 2*a*, 2*b*, 2*c* accordingly. Consequently, the inspection station 10 must be provided for threefold inspection and the coiling is carried out also in three parallelly operating stages 3*a*, 3*b* and 3*c*. However, the uncoiling is provided as a single unit only and all of the equipment downstream and involving the strip rolling operation is also provided in a single line configuration only. The uncoiled strip is descaled in a scrubber 13 prior to passing through a six stand finishing rolling line 11*a* through 11*f*. This finishing rolling operation reduces the thickness of the strip or skelp to the final cross-sectional dimension, and the resulting strip is coiled in the below-floor reeling and coiling device 9.

Turning now to some operational particulars, FIG. 1 is provided for casting a relatively thin steel ingot of the slab ingot type having a thickness from 20 to 65 mm and a width for example in the range from 500 to 1,500 mm. Continuous casting machines for casting this type of slab ingots generally are known per se but are not usually provided for casting strings having such dimensions. The ingot as stated is veered into the horizontal and depending upon the casting speed, the cutter 2 is operated whenever the length of the casting that has passed has reached a value that can still be handled by the coiling device 3. This depends to a considerable extent upon the weight of the resulting coil. Particularly, the operation can be carried out under more or less continuously measuring the weight and when the desired coiling weight has been reached the cutter is operated.

The coiling station 3 should be spaced from the transverse cutter 2 such that immediately following a cutting step the casting i.e. the remainder of the string is coiled at an accelerated rate so that a certain gap is established between the front end of the casting as it continues to emerge from the casting plant. This gap can be translated into a period of time which is now made available for transferring the coil from the coiling station 3 into the buffer furnace 4 before the freshly made end of the casting string arrives at the coiling station 3. This, of course, is important as the cutting and transfer operation of the coil should by no means cause an interruption in the casting operation. Therefore, from the point of view of the casting, a continuous operation is carried out and the operations downstream have to accommodate this aspect accordingly.

As was briefly mentioned above, the coil remains in the furnace 4 for a certain period of time and is then transferred to the uncoiling station 5 wherein in fact now the slab ingot is restored as to its flat configuration. There may be some straightening operation interposed and by means of suitable rolls the flattened casting is passed underneath the reeling furnace into the rolling stand 7 and rolled flat following which the flattened ingot or strip is coiled in the reeling furnace 8 for temporary storage. Subsequently, the direction of rolling is reversed and the strip is further reduced in another reversed pass and is now coiled in the reeling furnace 6.

It can readily be seen that the strip can now be stepwise reduced in several passes wherein the direction of rolling is alternated and the strip is uncoiled from one of the furnaces 6, 8 and coiled in the respective other one following which the operation is reversed. This procedure can be followed until the strip has reached the desired dimension whereupon rolling is discontinued and the strip is coiled in the reeling and coiling station 9 disposed underneath the floor of the operating equipment.

It can readily be seen that the operation as described is exactly the same as per FIG. 3, there just is a change in the transfer direction as far as the coil is concerned; as seen in relation to the buffer furnace 4 uncoiling is carried out in station 5 in a direction opposite of the coiling that is carried out in station 3.

Many aspects of the operation are the same as per the equipment shown in FIG. 4 whereby, however, the coiling of the strip is carried out in fact under supervision of the hot inspection station 10. Also as stated the coiling and cutting is carried out in dependence on the new attained weight. Most importantly, multiple casting lines feed a single one directional rolling line.

The coiling stations 3 as well as the uncoiling station 5 are both incorporated or arranged within the furnace 4 in order to preserve, basically, the heat content of the continuously cast ingot to the largest extent possible. In other words, as soon as the preprocessing of the cut ingot strip has been completed further outflux of heat is prevented as much as possible and that prevention is continued as long as possible, i.e. up until such time the particular coil can be uncoiled for further processing downstream from the uncoiling station 5. This is particularly critical in the case of the arrangement shown in FIG. 4 wherein three separate casting processes service a single strip rolling line.

As stated the scale that may have developed on the surface of the casting is removed in the station 13 and the casting is thus cleaned and scrubbed. Strip or skelp is then passed directly into the first stand 11*a* of the six stand rolling mill. As stated the strip is reduced in thickness, i.e. the rolling produces stepwise the desired final cross section of the strip which is then reeled and coiled in station 9. The arrangement shown in FIG. 4 considers the fact that the casting process is in fact slower generally than the rolling process particularly if rolling is carried out in a single straight through passage as shown in FIG. 4. This indeed permits the rolling to accommodate more than one continuous casting operation. It is merely required to equip the furnace 4 with a suitable transport structure which permits each of the outer two coils as a result from the casting machines 1*a* and 1*c* to be placed on line with the more centrally arranged uncoiling structure 5 which, of course, is in line with the rolling facilities downstream. In comparison with FIG. 1 it can be seen that the structure of the latter Figure is simpler as far as the rolling process is concerned and here the comparative slowness of the casting process is made use of by permitting the same rolling stand to roll down the strip in several back and forth passages until the next coil is ready for removal from the furnace 4.

The invention is not limited to the embodiments described above but all changes and modifications thereof not constituting departures from the spirit and scope of the invention are intended to be included.

We claim:

1. Method for making steel strip by means of operating steps carried out in immediate sequence and comprising the steps of:

continuously casting a strip-like but relatively thick ingot which solidifies;

Next, coiling the strip-like casting following solidification for obtaining a plurality of coils on a continuous basis commensurate with the casting process, while retaining a significant amount of heat in each coil;

cutting the casting upon completing a particular coil for obtaining the coils of the plurality;

uncoiling coils of the plurality of coils as produced on a continuing basis; and hot rolling each uncoiled strip down, one after another to a thinner strip or skelp.

2. Method as in claim 1 and including the step of temporarily storing the coil in a furnace for retention of the heat content of the coiled strip.

3. Arrangement for the manufacture of steel strip or skelp comprising:

means for continuous casting of strip-like ingot material;

means disposed downstream from the means for casting for coiling the strip-like ingot;

means disposed for transversely cutting the strip-like ingot at a location between the means for casting and the means for coiling;

means for transferring a coil from the means for coiling to obtain temporary buffering;

means connected to the means for transfering to receive therefrom a coil as buffer- and provided for uncoiling the coiled strip; and rolling means disposed in line with said means for uncoiling for reducing the thickness by means of hot rolling to a thinner strip.

4. Equipment as in claim 3 and including a furnace, said means for transferring being included within said furnace.

5. Equipment as in claim 4, said furnace being a rotary hearth furnace.

6. Equipment as in claim 3, said means for rolling including a roll stand for bidirectional operation, there being furnaces disposed to both sides of the means for rolling as seen in the direction of rolling, for coiling and uncoiling the strip during sequential passages through the mill in alternating sequence.

7. Equipment as in claim 3, said means for rolling being a plural stand, continuously and uni-directionally operating hot rolling mill.

8. Equipment as in claim 3, said means for continuous casting being arranged at some distance but alongside said means for rolling.

9. Equipment as in claim 3, and including means for descaling the uncoiled strip being disposed upstream from the means for rolling.

10. Equipment as in claim 3, and including means for hot inspection of the casting and being disposed between said means for casting and said means for coiling.

11. Equipment as in claim 3, and including an additional means for rolling disposed between the means for casting and the means for coiling.

12. Equipment for the manufacture of steel strip comprising:

a plurality of means for respectively casting a plurality of steel strips in parallel operation;

a plurality of cutting means respectively for transversely cutting said cast strips;

a plurality of coiling means for separately coiling the cast strips as cut;

a single uncoiling means for uncoiling the coiled strip;

means for transferring a coiled strip from each of said means for coiling of the plurality to said single means for uncoiling; and means for hot rolling said uncoiled strip.

13. Equipment as in claim 12, the means for transferring being included in a furnace.

14. Equipment as in claim 13, said means for coiling and for uncoiling all being included in the furnace.

* * * * *